United States Patent [19]

Marzoli

[11] 4,000,541

[45] Jan. 4, 1977

[54] INSTALLATION FOR METERING TEXTILE FIBERS

[75] Inventor: Angelo Marzoli, Bergamo, Italy

[73] Assignee: F.lli Marzoli & C. S.P.A., Bergamo, Italy

[22] Filed: Apr. 4, 1975

[21] Appl. No.: 565,252

[30] Foreign Application Priority Data

Apr. 10, 1974 Italy ..... 21222/74

[52] U.S. Cl. ..... 19/81; 19/145.5

[51] Int. Cl.[2] ..... D01G 7/00

[58] Field of Search ..... 19/80 R, 81, 145.5; 241/101 A

[56] References Cited

UNITED STATES PATENTS

| | | | |
|---|---|---|---|
| 2,885,741 | 5/1959 | Leineweber, Jr. | 19/145.5 |
| 3,040,387 | 6/1962 | Jee | 19/81 |
| 3,577,599 | 5/1971 | Goldammer et al. | 19/145.5 |

FOREIGN PATENTS OR APPLICATIONS

| | | | |
|---|---|---|---|
| 519,873 | 3/1931 | Germany | 19/80 R |

*Primary Examiner*—Dorsey Newton

[57] ABSTRACT

An installation is disclosed for continuously and automatically performing the admixture of textile fibers of different natures prior to spinning. The fibers are taken from bales of different fibers continually, the metering of fibers of each individual kind being automatically controlled by a scale, the seizing device having a bridge-like configuration and being moved along a closed or open loop path. The component fibers of the admixture are then dumped into a specially provided container, wherefrom they are fed forward to subsequent processing and/or treatment machines.

7 Claims, 4 Drawing Figures

INSTALLATION FOR METERING TEXTILE FIBERS

BACKGROUND OF THE INVENTION

This invention relates to a method for taking textile fibers out of bales, in a metered amount, to transfer them subsequently to the spinning processing run. The invention also relates to an installation for carrying out the method in question.

It is known that textile fibers, in order that they may be subjected to spinning operations, must be properly metered, also in order that they may be admitted in a constant and preselected percentage with fibers of a different nature.

Up to now, the operations intended to take the fibers out have been carried out either manually or by tong-like prehensile devices for grasping the fibers out of the bales. After grasping, the amount which had been taken out had to be metered either to add metered amounts of other fibers thereto, or to convey it directly to a first fiber-processing machine. The grasping and metering cycle had to be performed intermittently and was carried out on a more or less straight line with many dead times and with the employment of a large amount of workmanship.

An object of the present invention is to redress the above enumerated defects while rendering the grasping and metering operations of the textile fibers automatic, thus bringing to an optimum condition not only the working time of the machines but also the exploitation of the space required thereby.

SUMMARY OF THE INVENTION

This object is achieved by a method, whereby the textile fibers are taken out of bales, also of different kinds of fibers, each grasping step being carried out continually and being connected with a metering step which can be adjusted according to the individual requirements, grasping steps of fibers of a certain nature being able to be followed by grasping operations of fibers of a different nature in order to obtain admixtures of different fibers with a differential or uniform percentage, the metered amount or the combination of fibers being fed to a conveyance line connected to textile fiber processing units.

The invention also provides an installation for carrying the method into practice, the installation comprising at least a machine for simultaneously grasping and metering the fibers, said machine being capable of being independently displaced along a ringlike guiding path in correspondence with which groups of bales are arranged. The machine has a bridge-like configuration so as to be positioned over the bales to grasp the fibers. In the bridge there is vertically movable a rotary spiked apron, which is arranged horizontally and is capable of seizing the fibers of a bale. At the outlet end of the spiked apron there is arranged a conveyance means for feeding the fibers forward, via further conveyors, to a metering device. The latter is properly adjustable as a function of the amount of fibers one desires to dispense. The engagement and disengagement of the spiked apron with and from the fibers can be controlled, with advantage, in such a way that the metering device may dump the desired amount of fibers into a container of the machine when the spiked apron is withdrawn from the bale. The machine, on completion of a grasping and metering operation, is moved stepwise in correspondence with another bale of the same kind or of a different kind of fibers, so that the same operation is carried out with either an equal or different metered amount of fibers. On completion of the obtention of the admixture or, in general, of a desired metered amount, the machine is caused to advance towards a dispensing machine, the latter being adapted to convey the fibers to processing or treatment machines.

BRIEF DESCRIPTION OF THE DRAWINGS

With reference to the figures of the accompanying drawings, the invention will be further explained in connection with an embodiment thereof, given by way of example only and without limitation.

In the drawings.

DESCRIPTION OF THE PREFERRED EMBODIMENT

Figure 1:
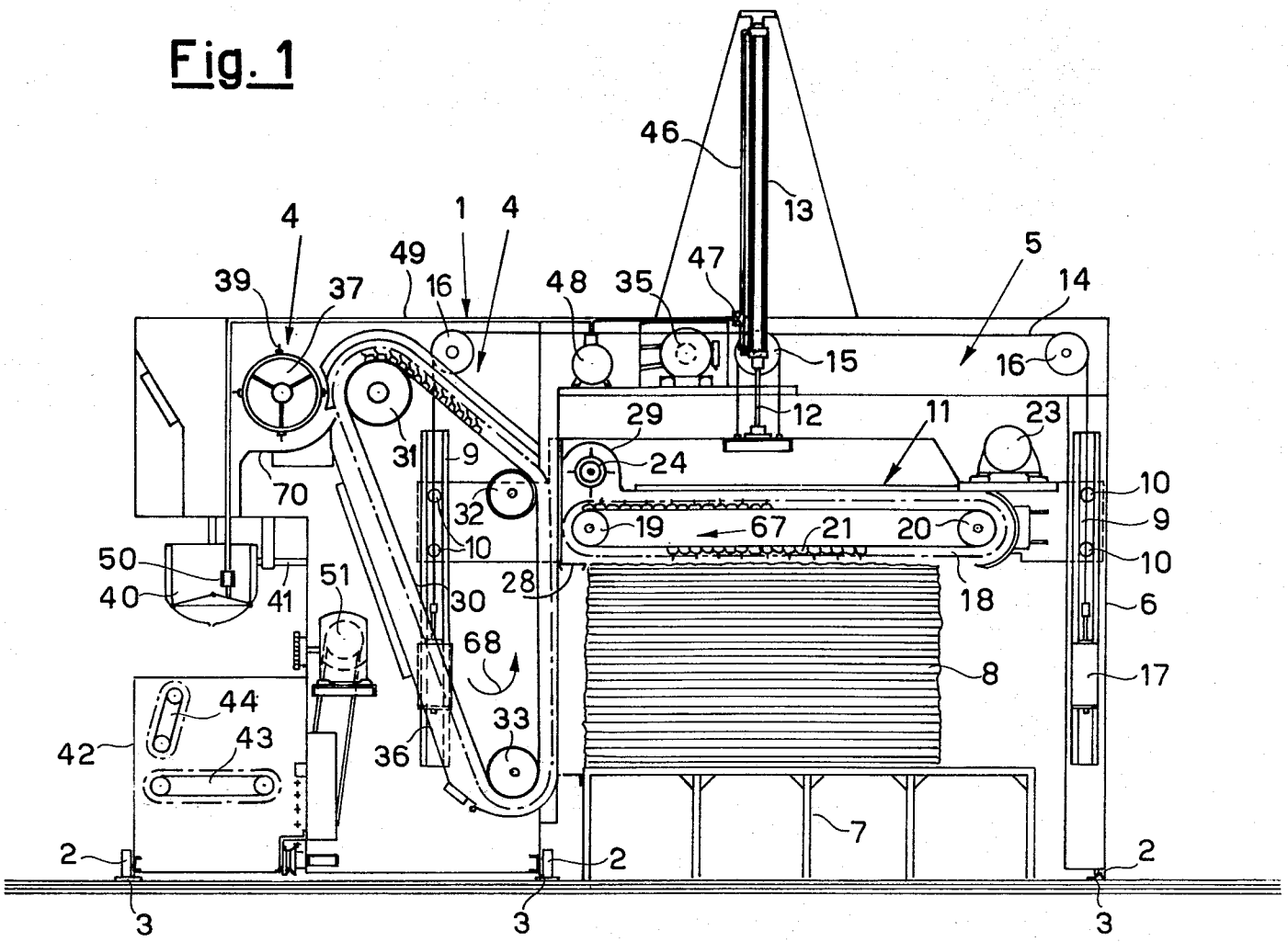
FIG. 1 shows a vertical cross-sectional view of a fiber grasping and metering machine.
Figure 2:
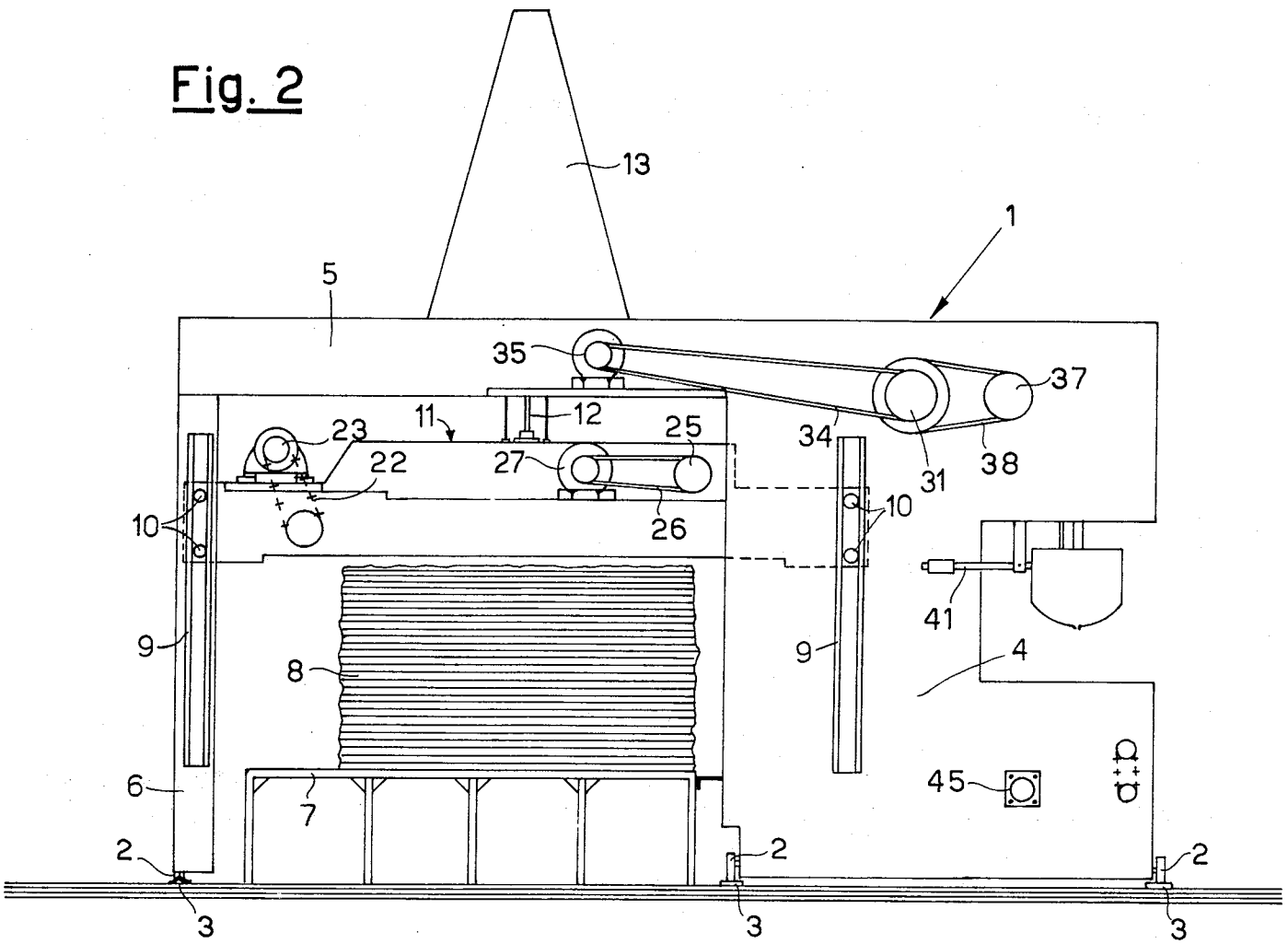
FIG. 2 shows the same machine as viewed from the rear.
Figure 3:
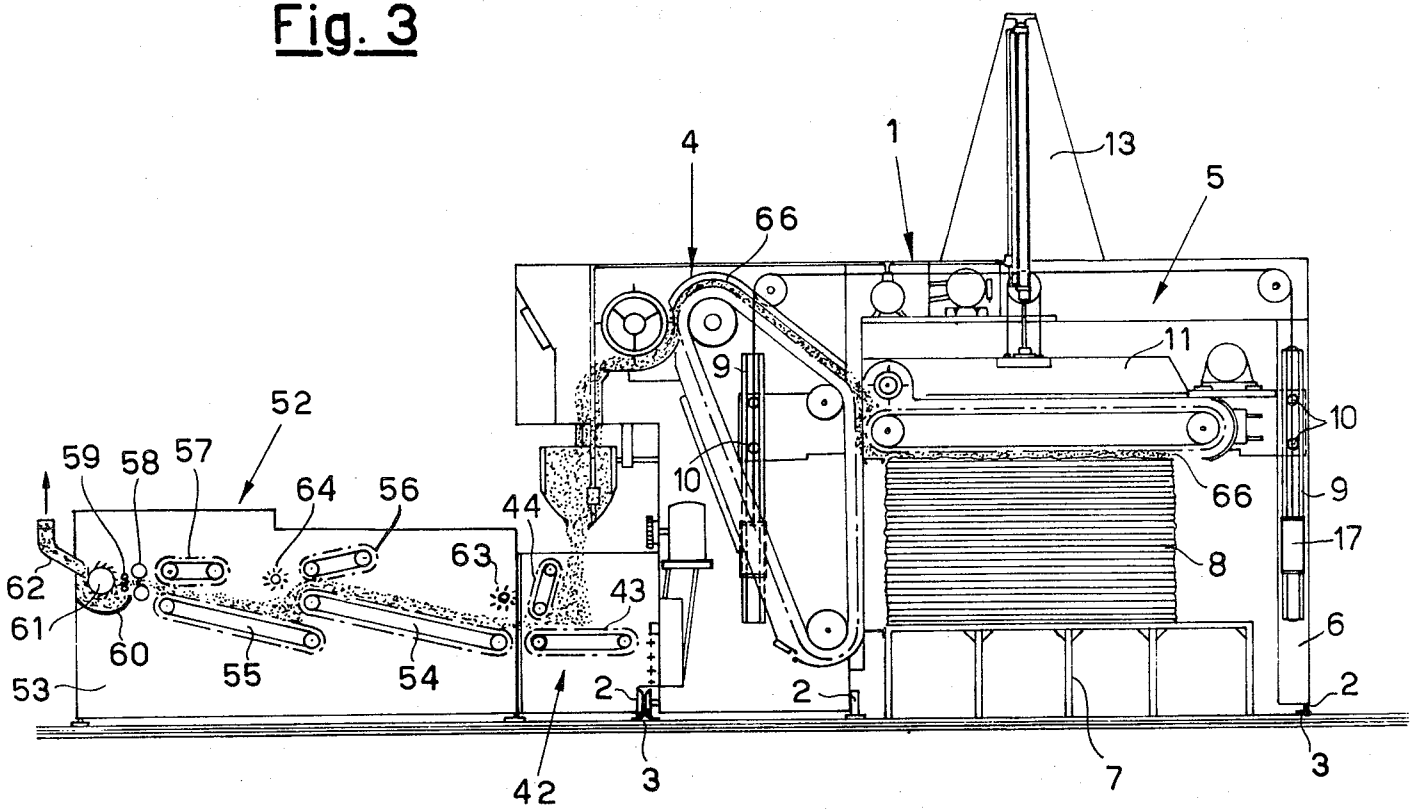
FIG. 3 is a vertical cross-sectional view of the same machine connected to a dumping and fiber conveying machine.

With reference to FIGS. 1, 2 and 3, the machine for grasping and metering the fibers is formed by a framing, generally shown at 1, which can be moved on a guideway formed by rails 3 by means of wheels 2. The framing comprises a substantially boxlike portion 4, from which a bridge portion 5 extends, having an upright 6.

The bridge 5 can be arranged on a platform 7, on which a bale 8 of textile fibers is laid (FIG. 1). The bridge 5 is equipped, on the side of the portion 4 and in correspondence with the upright 6, respectively, with vertical guideways 9 (these are not shown on the side of the portion 4), on which, by the agency of wheels 10, slides a dolly 11. The latter, via a stem 12, is mechanically connected to a double acting hydraulic or pneumatic ram 13, which is controlled in the manner to be described hereinafter, and which projects upwards from the framing 1. The dolly 11 is additionally connected, by ropes 14, supported for rotation by pulleys 15 and 16, to a counterweight 17.

The dolly 11 carries, overhead, through rollers 19 and 20, a horizontal conveyor belt 18 the width of which is adapted to the size of the bales 8 and is extended substantially along the entire span of the bridge 5. The spiked apron 18 is equipped, in correspondence with its outer surface, with grasping means, such as wooden slats which carry metal points 21. The roller 20 of the spiked apron 18 is mechanically connected, via a chain 22, with a motor 23 as mounted on the dolly 11 (FIG. 2).

On one end of the spiked apron 18, above the roller 19, there is arranged for rotation a separator 24, actuated through a pulley 25 and a belt 26 by a motor 27 (FIG. 2). The dolly 11 has, in addition, a lower portion of metal sheet 28 and a top baffle 29 which partially surrounds the separator 24 towards the outside relative to the belt 18. Between the sheet metal sheet 28 and the baffle 29 an opening is formed, which confronts the portion 4.

Through the portion 4 there is provided a window from which a conveyor belt 30 protrudes, which is both guided and borne by cylinders 31, 32, 33, of which the cylinder 31 is driven to rotation through the belt 34 by a motor 35 as mounted on the bridge 5. The lap of the belt 30 which is taut between the cylinders 32 and 33 substantially extends along the whole stroke of the dolly 11 in the vertical direction. The conveyor belt 30, in correspondence with its other laps is surrounded by a holding apron 36. Only in correspondence with the cylinder 31, the apron 36 is open to allow a drum 37, a drive for which is taken from that of the cylinder 31 via a belt 38, to sweep with its drag members 39 the outlet from the belt 30. Beneath the drum 37 there is arranged a baffle 70 which is extended to a metering device 40, substantially formed by a weighing scale 41, the latter being adapted to cause the opening of the metering device downwards. The details of the metering device 40 are not further explained or illustrated as they are conventional.

The metering device 40 is arranged over a container 42, in which there are arranged conveyor belts 43 and 44, horizontal and slanting, respectively, so as to provide a preselected compulsory conveyance route. They are appropriately actuated by a motor 45.

To actuate the cylinder 13, the latter, via a duct 46 and an electro-magnetic valve 47, is connected to a compressor 48 mounted on the bridge 5. The compressor 48, through a line 49, feeds with compressed air also the ram 50 which is adapted to open the metering device 40, the ram being controlled by the scale 41 in such a manner as to be driven to open the metering device 40 when the scale 41 senses a predetermined weight— (for example, the swinging arm of the scale 41 could actuate an electric contact, not shown in the drawings, which in turn controls the air supply for the ram 50).

The whole machine travels on the rails 3 as driven by a step motor 51, which properly acts upon the wheels 2.

Alongside the guideway formed by the rails 3, on the side of the laterally open container 42, there is arranged a fiber discharging and dispensing machine, generally shown at 52 (FIG. 3). The machine is basically composed by a stationary casing 53; in which there are mounted two lower conveyor belts 54 and 55, slanting in the same direction, mutually partially superposed and properly actuated. The belt 54 is extended to the open end of the casing 53 facing the side of the rails 2 at the level of the belt 43. The other end of the conveyor 54 lies beneath a smaller conveyor belt 56, while the conveyor 55 has, overlying it, a smaller conveyor belt 57. The top conveyor belts 56 and 57 are so slanting with respect to the corresponding lower conveyor belts as to provide a conveyance path.

Downstream of the conveyor belts 54, 55, 56, 57 there are two rotatable couples of superposed cylinders 58 and 59. The two couples 58 and 59 ar arranged one past another at about the same level. The couple 59 is equipped at its inlet with a retaining grid 60 in which there is inserted a spider wheel 61, the latter being rotated in the vicinity of the opening of a mouth 62 of a conveyance line towards additional processing machines.

On the outlet side of the couple of belts 43, 44 above the belt 54 there is applied a photoelectric detector 63, as well as in the vicinity of the outlet of the couple 54, 56 where there is a photoelectric detector 64.

To explain the operation of the machines described hereinabove let it be assumed that they are used in an installation as diagrammatically shown in FIG. 4. As seen in the drawing, the rails 3 are installed in a closed loop arrangement, substantially of an elliptic outline. The bales 8, conversely, are placed side by side in groups A, B, C, D, E, F, G, H, and each group can be made up with a different kind of textile fibers. To grasp and to meter the fibers, there are provided two machines 1, to each of which a machine 52 is respectively associated. The two machines 52 are mounted stationary in the inside of the loop of the rails 3, on diametrically opposite sides. They are additionally connected, through pipes 65, with textile fiber processing machines, not shown.

Figure 4:
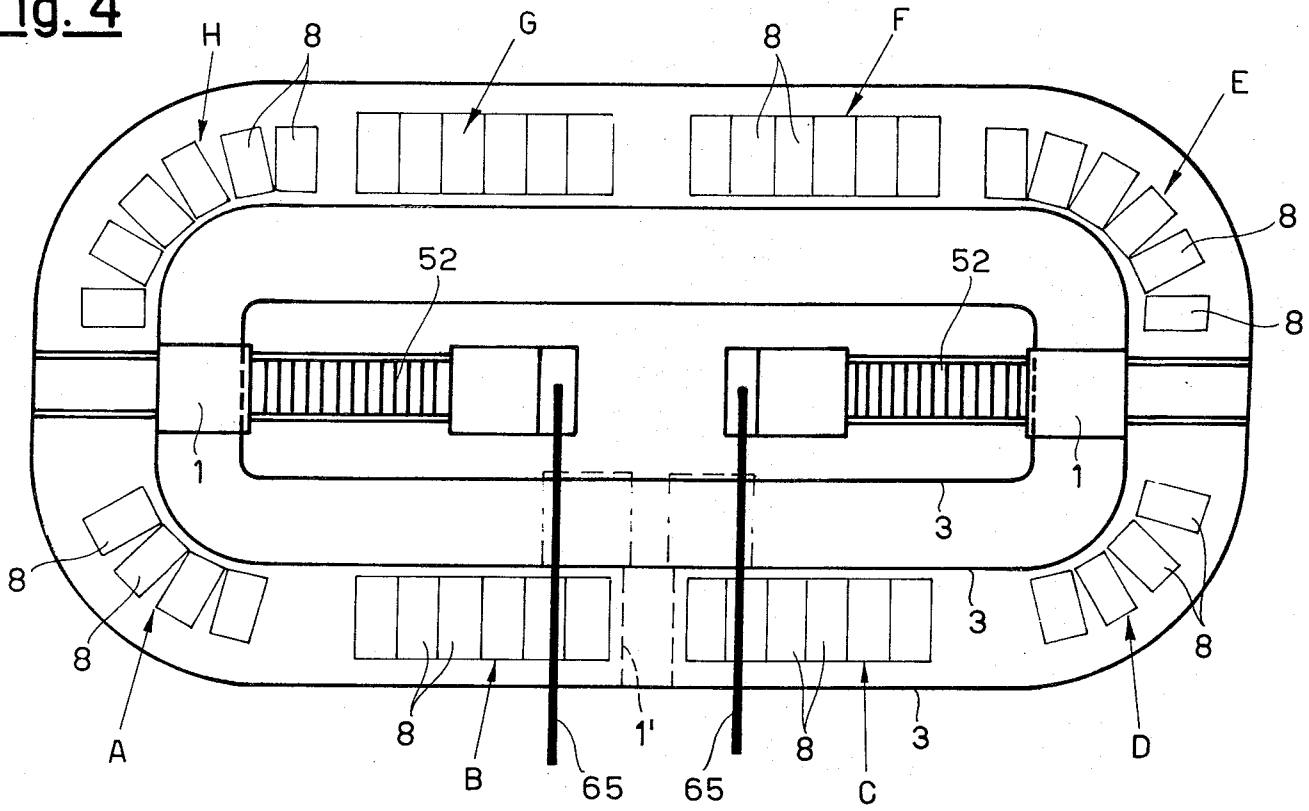
FIG. 4 shows a complete installation embodying this invention.

The grasping cycle can be started with the machine 1 in the position 1' as shown in FIG. 4 in phantom. By being actuated, the belt 18 is displaced in the direction of the arrow 67 and the separator 24 is rotated in the contrary direction. The dolly 11 is lowered onto the bale 8 by the agency of the cylinder 13 and the electromagnetic valve 47 is actuated. The weight of the dolly 11 is balanced by the weight 17 so as better to control the contact of the spiked apron 18 with the top surface at the bale 8. As the spiked apron 18 takes grasp on the bale 8, fibers 66 are withdrawn from the bale in a continuous way and the thickness of the layers is a function of the pressure imparted by the cylinder 13.

The fibers 66 are conveyed in correspondence with the belt 30, since their return to the upper lap of the belt 18 is prevented by the separator 24. The belt 30, by being rotated in the direction of the arrow 68, seizes the fibers 66 emerging from the spiked apron 18 and conveys them in correspondence with the cylinder 38 which rotates in the opposite direction and at a higher speed and withdraws the fiber mat from the belt 30. Subsequently, the fibers are passed to the metering device 40, where they are collected, until the scale 41 senses a predetermined weight, corresponding to the desired amount of fibers, and consequently controls the cylinder 50 to open the device 40. The cylinder 50 opens the metering device 40 at the bottom thereof and the fibers 66 fall into the container 42 in the belt 43. At this stage the electromagnetic valve 47 is operated to act — (the electromagnetic valve 47 can be operated either manually or automatically in known manner) on the cylinder 13 in a manner which is the opposite of the previous one so that the dolly 11 withdraws the spiked apron 18 from the bale 8. Subsequently, the step motor 51 enters action and displaces the machine, for example, from a bale of A to a subsequent bale, or also to a bale 8 of the group B of a different kind. The machine thus carries out the same operations as before, thus achieving a combination of fibers with fixed percentages of different fibers.

The machine 1, as it has reached the desired combination of fibers, is stopped in correspondence with the machine 52. By actuating the motor 45, the tapes 43 and 44 convey the fibers on the belt 54; the belts 54 and 56 convey them onto the belt 55, while the belts 55 and 57 feed them between the cylinders 58 and then between the cylinders 59. The rotating spider wheel 61 is rotated clockwise (FIG. 3) and feeds the fibers 66 to the mouth 62 wherefrom the fibers are conveyed to the next processing machines through the line 65. The fiber flow is controlled by the detectors 63 and 64 which, in the case of jamming, stop the machine.

The second machine, 52, operates in the same way.

The machine 52 in its function could replace a set of mixing loaders since by its agency a homogeneous admixture is obtained of the ingredients of the admixture, an initial opening and a preliminary cleaning of the fibers being concurrently achieved (grid 60, spider wheel 61).

Instead of two machines 1 in the described installation, even a single machine, or a few grasping and metering machines could be provided for, it being possible, for example, to combine with a number of machines such as 1 a single stationary machine 52.

Instead of a rail closed loop, an open ring could also be provided for, for example a semicircular loop.

Obviously, the operative cycle of the machine could also be carried out otherwise then as described above; thus its starting position could coincide with the end position by carrying out a reciprocal excursion towards the starting position as described above.

In the example shown there have not been described in detail the actuating mechanisms since they are well known to those skilled in the art. All the controls for moving the belts, the pneumatic circuitry and so forth could be completely centralized and automated.

What is claimed is:

1. An arrangement for feeding metered amounts of textile fibers, comprising at least one machine for grasping and metering the fibers, a guideway including support means for longitudinally spaced bales of fibers, driving means for moving said grasping and metering machine step by step along said guideway to successively position it over different bales of fibers and at least one discharging and dispensing machine arranged in a predetermind position along the guideway so as to be operatively engaged by the grasping and metering machine at the end of an operating movement of the latter along the guideway, said grasping and metering comprising a bridge-like portion transversally arranged over the guideway so as to be successively superimposed to the spaced bales, a rotary spiked apron horizontally arranged and vertically displaceable in said bridge portion so as to engage the top of a bale below to grasp and horizontally displace the upper fibers thereof, conveying means arranged to receive the fibers displaced by the spiked apron and to convey them towards a metering device, means to actuate said metering device to dump the metered fibers into a container when a predetermined amount of conveyed fibers is metered, spiked apron lifting means operable when said predetermined amount of conveyed fibers is metered to disengage the spiked apron from the bale and further conveying means associated with the container to receive the fiber dumped by the metering device and to subsequently transfer them to the discharging and dispensing machine at the end of an operating movement of the grasping and metering machine along the guideway.

2. An arrangement according to claim 1, wherein the guideway is a rail arranged in closed loop.

3. An arrangement according to claim 2, wherein the guideway has an elliptic outline.

4. An arrangement according to claim 1, wherein said further conveying means comprise two-belt conveyors inclined one towards the other in the shape of a funnel, one of said belt conveyors being arranged horizontally to receive the fibers dumped by the metering device.

5. An arrangement according to claim 1, including a dolly for supporting rotatably the spiked apron, said dolly being vertically slidably arranged within the bridge portion, control means for controlling the vertical movement of the dolly, said control means including a double-acting pneumatic ram, a pneumatic compressor connected to said pneumatic ram and a control valve inserted between said compressor and said ram said compressor being also connected to a further pneumatic ram acting on the metering device to cause dumping operation thereof.

6. An arrangement according to claim 5, wherein said dolly has a counterbalancing weight.

7. An arrangement according to claim 1, wherein the discharging and dispensing machine is provided with photoelectric detectors to control the flow of fibers therethrough.

* * * * *

UNITED STATES PATENT AND TRADEMARK OFFICE

CERTIFICATE OF CORRECTION

PATENT NO. : 4,000,541
DATED : January 4, 1977
INVENTOR(S) : Angelo Marzoli

It is certified that error appears in the above-identified patent and that said Letters Patent are hereby corrected as shown below:

On the Title Page, Item [73] should read:

--F.LLI MARZOLI & C. S.p.A.,
(Brescia - Italy)--

Signed and Sealed this thirtieth Day of August 1977

[SEAL]

Attest:

RUTH C. MASON
*Attesting Officer*

C. MARSHALL DANN
*Commissioner of Patents and Trademarks*